US008683800B2

(12) United States Patent
Cunningham et al.

(10) Patent No.: US 8,683,800 B2
(45) **Date of Patent: *Apr. 1, 2014**

(54) METHOD AND SYSTEM FOR PROVIDING VACUUM

(75) Inventors: Ralph Wayne Cunningham, Milan, MI (US); Moses Alexander Fridman, Birmingham, MI (US); Todd Anthony Rumpsa, Saline, MI (US); Mansour Beshay, Ann Arbor, MI (US); Cliff Maki, New Hudson, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 313 days.

This patent is subject to a terminal disclaimer.

(21) Appl. No.: 13/050,664

(22) Filed: Mar. 17, 2011

(65) Prior Publication Data

US 2012/0237367 A1 Sep. 20, 2012

(51) Int. Cl.
*F02B 33/44* (2006.01)
*F02B 33/00* (2006.01)

(52) U.S. Cl.
USPC ..... 60/611; 60/605.1; 60/601; 123/559.1

(58) Field of Classification Search
USPC ..... 60/605.1, 611, 601, 397; 123/559.1; 417/44.1–44.2, 151, 198
See application file for complete search history.

(56) References Cited

U.S. PATENT DOCUMENTS 5,005,550 A * 4/1991 Bugin et al. ..... 123/520
5,369,811 A * 12/1994 Serre ..... 4/213
6,120,414 A 9/2000 Endo et al.
6,347,608 B1 2/2002 Hara et al.
6,568,175 B2 5/2003 Izumiura et al.
6,735,942 B2 5/2004 Wild et al.
6,773,374 B2 8/2004 Ogawa et al.
7,216,479 B2 5/2007 Tamura
2008/0267789 A1 10/2008 Hirooka
2009/0320466 A1 * 12/2009 Vetrovec ..... 60/602
2011/0132311 A1 * 6/2011 Pursifull et al. ..... 123/184.56
2012/0016566 A1 * 1/2012 Cunningham et al. ..... 701/103

FOREIGN PATENT DOCUMENTS

JP 2005171925 A 6/2005
WO 2008084311 A1 7/2008

OTHER PUBLICATIONS

Karnik, Amey Y. et al., "Engine Vacuum System," U.S. Appl. No. 13/050,647, filed Mar. 17, 2011, 32 pages.
Cunningham, Ralph Wayne et al., "Method and System for Controlling Vacuum," U.S. Appl. No. 12/899,370, filed Oct. 6, 2010, 30 pages.
Pursifull, Ross Dykstra et al., "Intake System Including Vacuum Aspirator," U.S. Appl. No. 12/721,445, filed Mar. 10, 2010, 45 pages.

(Continued)

*Primary Examiner* — Thomas Denion
*Assistant Examiner* — Ngoc T Nguyen
(74) *Attorney, Agent, or Firm* — Julia Voutyras; Alleman Hall McCoy Russell & Tuttle LLP

(57) ABSTRACT

A vacuum source arbitration system is disclosed. In one example, vacuum is supplied to a vacuum reservoir via an ejector during a first condition, and vacuum is supplied to the vacuum reservoir via an engine intake manifold during a second condition. The approach may provide a desired level of vacuum in a reservoir while reducing engine fuel consumption.

20 Claims, 7 Drawing Sheets

(56) References Cited

OTHER PUBLICATIONS

Ulrey, Joseph Norman et al., "Method and System for Operating an Ejector," U.S. Appl. No. 13/050,632, filed Mar. 17, 2011, 35 pages.
Cunningham, Ralph Wayne et al., "A Method for Purging Fuel Vapors," U.S. Appl. No. 12/838,700, filed Jul. 19, 2010, 37 pages.
Pursifull, Ross Dykstra, "Method and System for Prioritizing Vehicle Vacuum," U.S. Appl. No. 13/050,700, filed Mar. 17, 2011, 40 pages.
Pursifull, Ross Dykstra et al., "Method and System for Providing Vacuum via Excess Boost," U.S. Appl. No. 13/050,683, filed Mar. 17, 2011, 46 pages.

* cited by examiner

METHOD AND SYSTEM FOR PROVIDING VACUUM

BACKGROUND/SUMMARY

Vacuum may be used to operate or to assist in the operation of various devices of a vehicle. For example, vacuum may be used to assist a driver applying vehicle brakes, turbocharger operation, fuel vapor purging, heating and ventilation system actuation, and driveline component actuation. Vacuum may be sometimes obtained from an engine intake manifold in normally aspirated engines because the intake manifold pressure is often at a pressure lower than atmospheric pressure. However, in boosted engines where intake manifold pressures are often at pressures greater than atmospheric pressure, intake manifold vacuum may replaced or augmented with vacuum from an ejector. By passing pressurized air though the ejector, a low pressure region may be created within the ejector so that air can be drawn from a vacuum reservoir to the ejector, thereby reducing pressure within the vacuum reservoir. Nevertheless, ejector systems may not provide a desired amount of vacuum or may operate less efficiently than is desired since ejectors have fixed dimensions that may be selected based on a limited operating range.

The inventors herein have recognized the above-mentioned disadvantages and have developed a method for providing vacuum for a vehicle, comprising: directing air from a compressor to an ejector; and adjusting a flow rate of air from the compressor in response to a rate of vacuum consumption within a vacuum system.

By adjusting a flow rate of air supplied from a compressor to an ejector it is possible to adjust a rate that vacuum is provided to a vacuum reservoir so that vacuum can be supplied to the reservoir at a rate that allows vacuum consumers within the vacuum system to operate as desired. Thus, the ejector may be controlled to provide vacuum at a rate that is related to the use or consumption rate of vacuum so that excess vacuum is not provided. Further, during conditions where the ejector may not have the capacity to provide a desired level of vacuum, air flow to the ejector may be deactivated and engine operation may be adjusted so that higher rates of vacuum are provided by an engine via the engine's intake manifold. In this way, it is possible to provide vacuum to a vacuum system while reducing engine fuel consumption since vacuum is provided according to vacuum use rather than simply operating the vacuum system at full vacuum supply capacity.

The present description may provide several advantages. For example, the approach may improve engine fuel economy by providing vacuum based on vacuum use rather than simply supplying a high level of vacuum. Further, the approach can prioritize vacuum use and vacuum generation according to operating conditions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
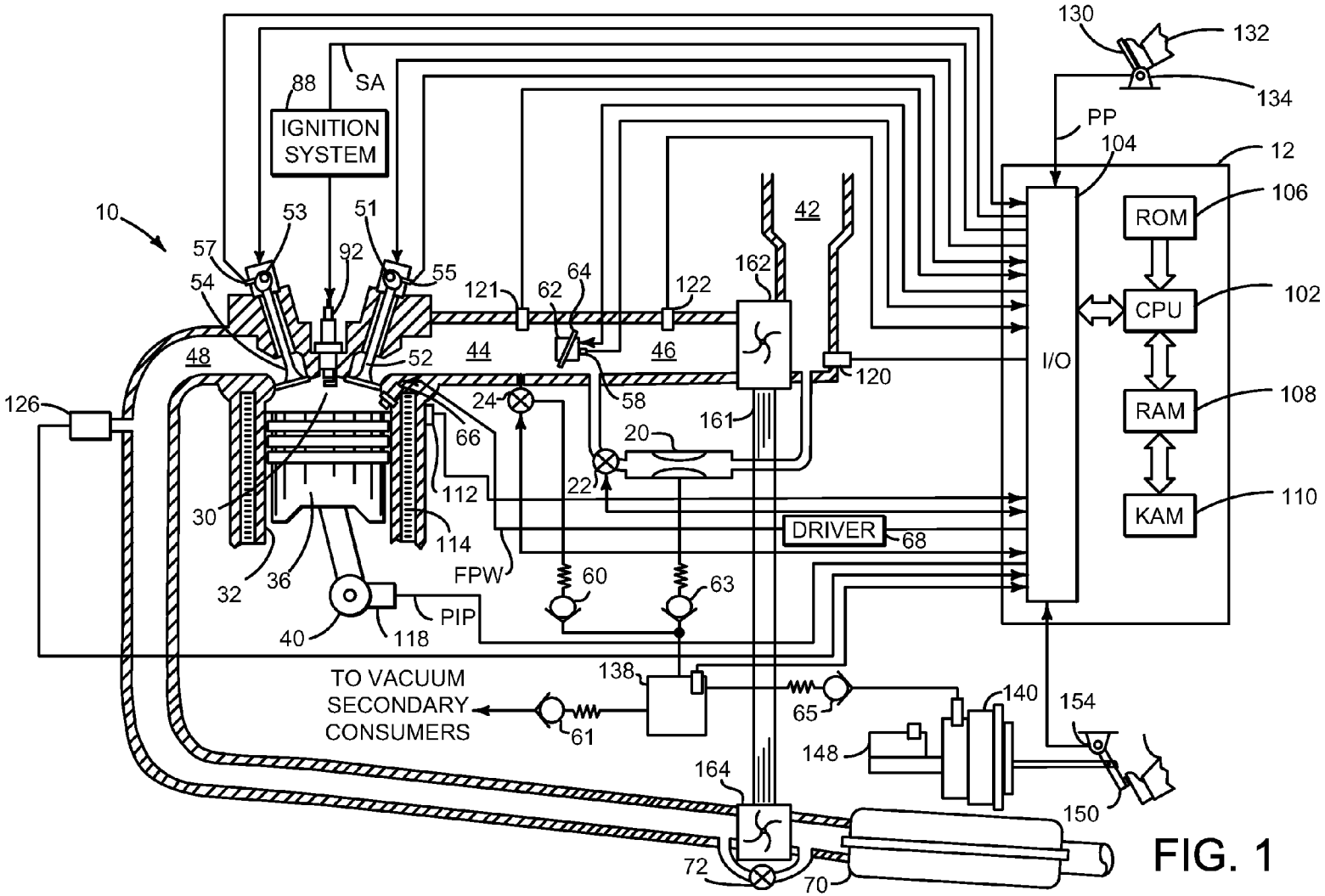
FIG. 1 shows a schematic depiction of an engine.
Figure 2:
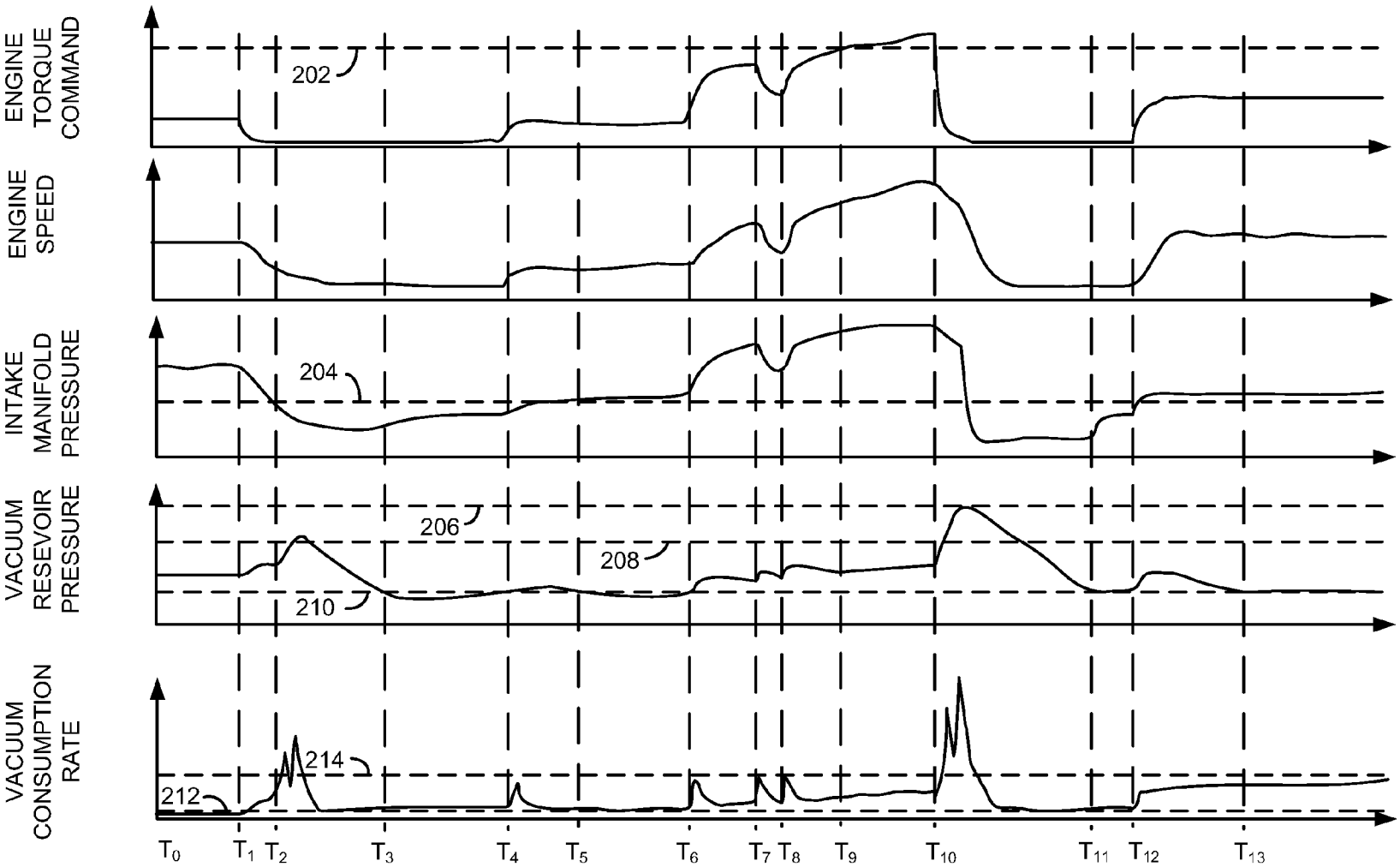
FIGS. 2-5 show simulated signals of interest during engine operation.
Figure 3:
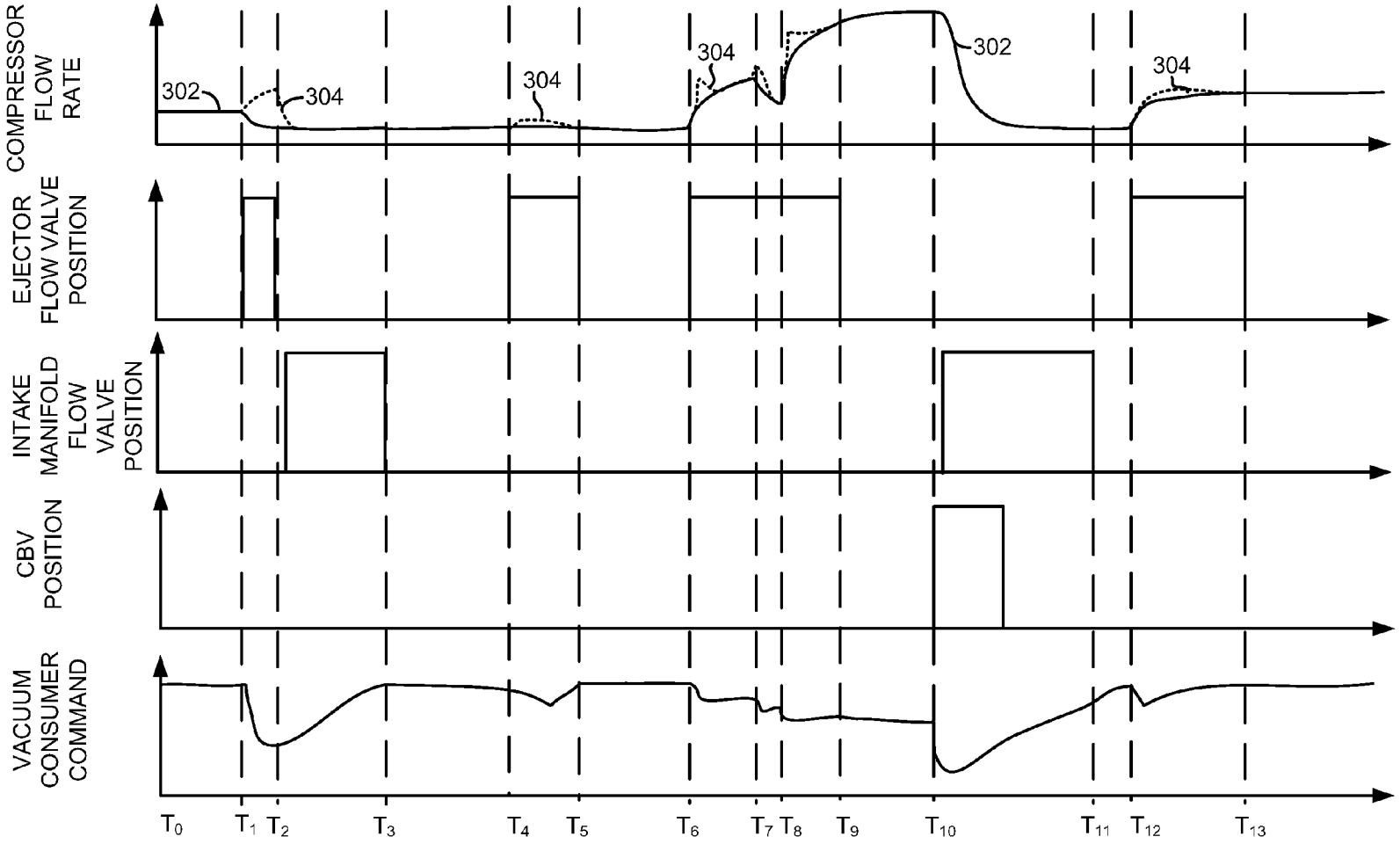
Figure 4:
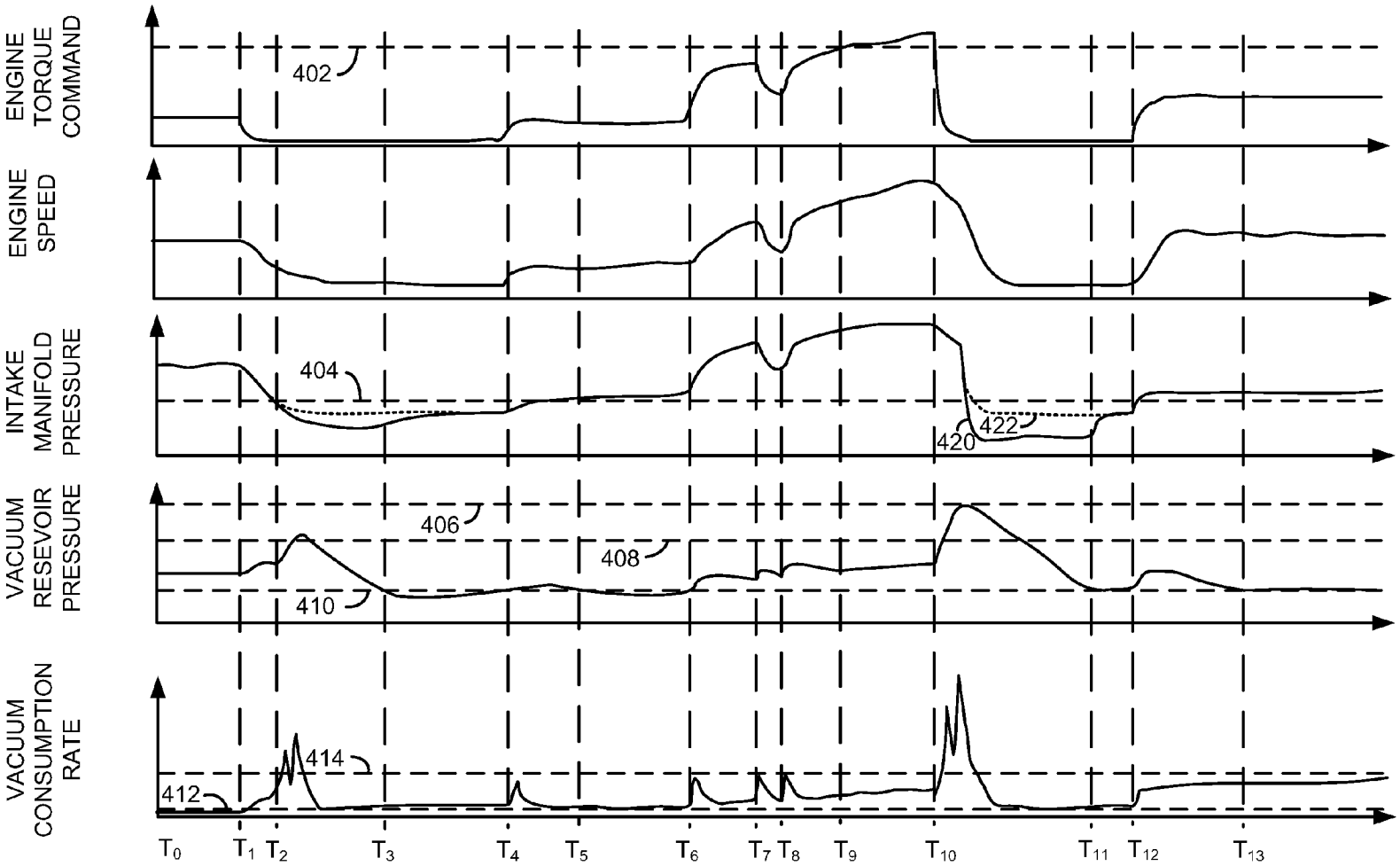
Figure 5:
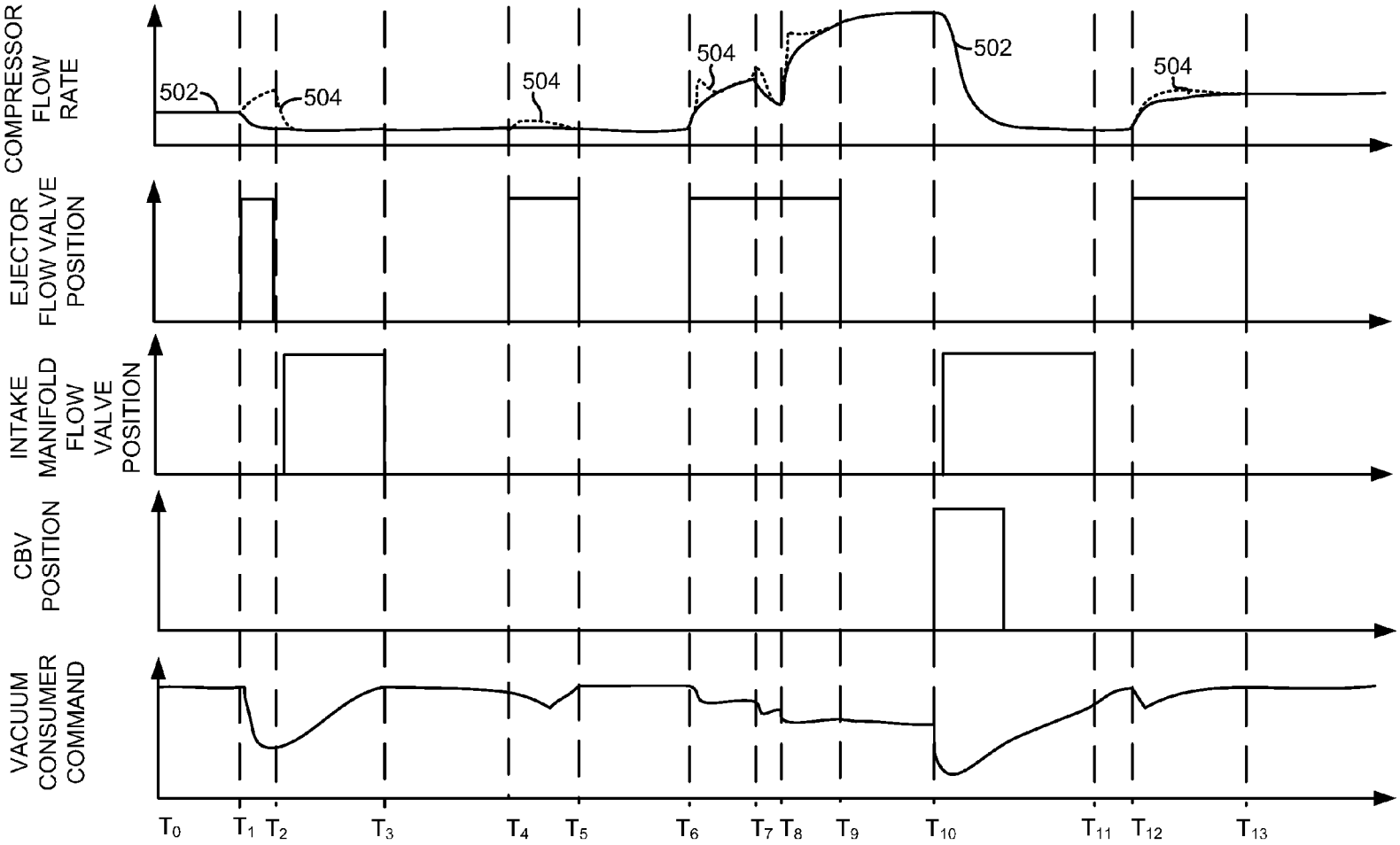
Figure 6:
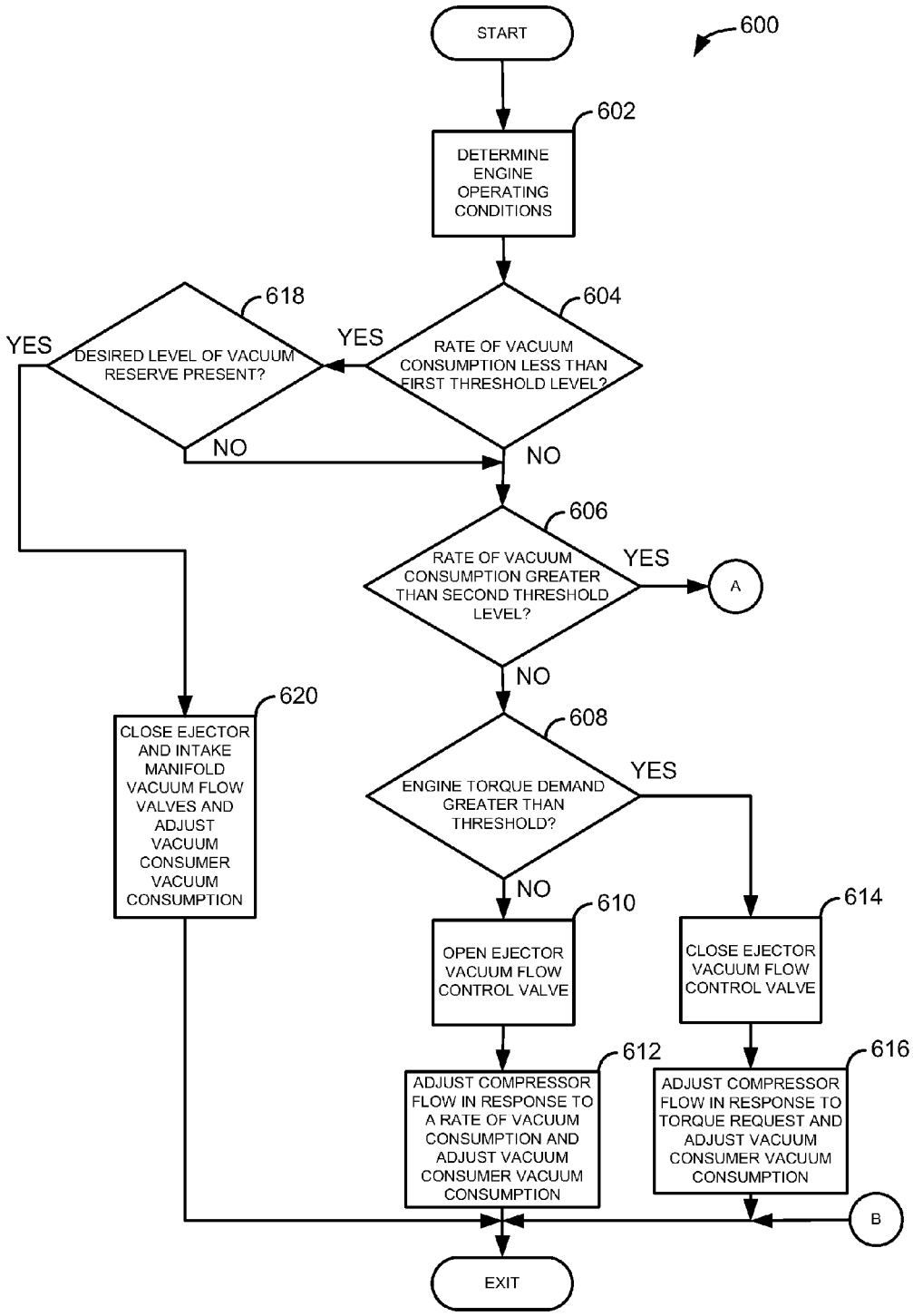
FIGS. 6-7 show a high level flowchart of a method for providing vacuum to a vacuum system of a vehicle.
Figure 7:
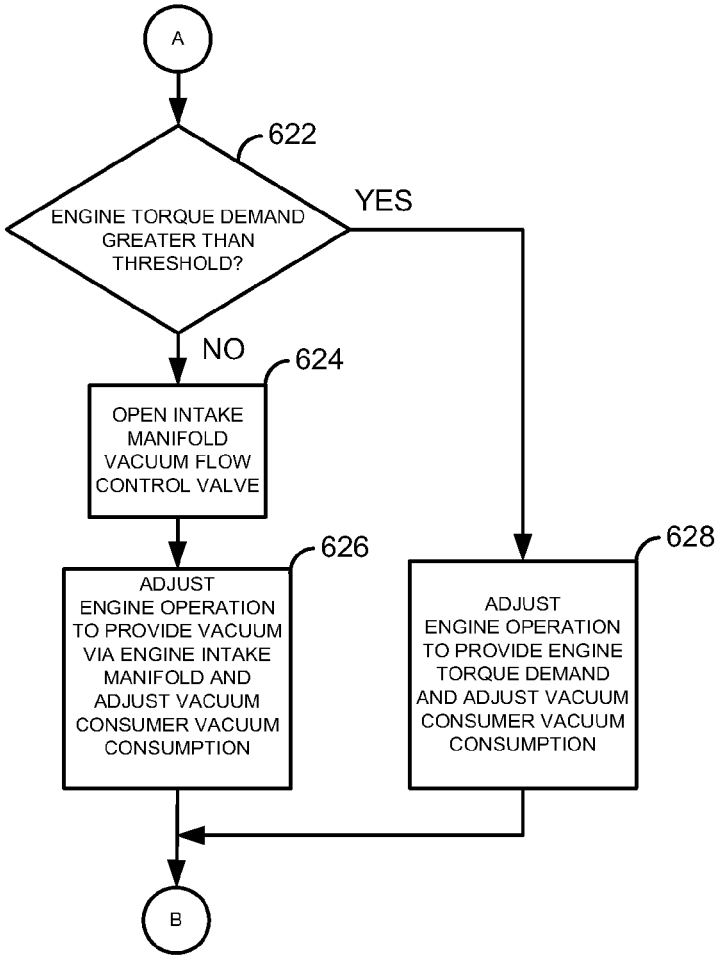

The present description is related to providing vacuum to assists in actuator operation. FIG. 1 shows one example embodiment for providing vacuum to a vehicle vacuum system. FIGS. 2 and 3 show simulated signals of interest when providing vacuum with an engine having a common intake manifold for all engine cylinders. FIGS. 4 and 5 show simulated signals of interest when providing vacuum with an engine having an intake manifold that is split between engine cylinders. For example, a first intake manifold passage supplies air to a first group of engine cylinders, and a second intake manifold passage supplies air to a second group of engine cylinders. Thus, the first intake manifold passage may operate at a first pressure while the second intake manifold passage operates at a second pressure. FIGS. 6-7 show a method for providing the vacuum and control illustrated in FIGS. 2-5.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46.

Compressor 162 draws air from air intake 42 to supply boost chamber 46. Exhaust gases spin turbine 164 which is coupled to compressor 162 via shaft 161. Vacuum operated waste gate actuator 72 allows exhaust gases to bypass turbine 164 so that boost pressure can be controlled under varying operating conditions. Vacuum is supplied to waste gate actuator 72 via vacuum reservoir 138. Vacuum reservoir 138 may be supplied vacuum from intake manifold 44 via intake manifold vacuum flow control valve 24 and check valve 60. Intake manifold vacuum flow control valve 24 is operated via an electrical signal from controller 12. In some examples, check valve 60 may be omitted. Vacuum reservoir 138 may also be supplied vacuum via ejector 20. Ejector vacuum flow control valve 22 may be opened to permit compressed air from compressor 162 to pass through ejector 20. Compressed air passes through ejector 20 and creates a low pressure region within ejector 20, thereby providing a vacuum source for vacuum reservoir 138. Air flowing through ejector 20 is returned to the intake system at a location upstream of compressor 162. In an alternative example, air flowing through the ejector 20 may be returned to the air intake system via conduits to the intake manifold at a location downstream of throttle 62 and at a location upstream of compressor 162. In the alternative configuration, valves may be placed between the outlet of ejector 20 and intake manifold 44 as well as between the outlet of ejector 20 and air intake 42. Check valve 63 ensures air does not pass from ejector 20 to vacuum reservoir 138. Air exits ejector 20 and reenters the engine air intake system at a location upstream of compressor 162. Vacuum reservoir 138 provides vacuum to brake booster 140 via check valve 65. Vacuum reservoir 138 may also provide vacuum to other vacuum consumers such as turbocharger waste gate actuators, heating and ventilation actuators, driveline actuators (e.g., four wheel drive actuators), fuel vapor purging systems, engine crankcase ventilation, and fuel system leak testing systems. Check valve 61 limits air flow from vacuum reservoir 138 to secondary vacuum consumers (e.g., vacuum consumers other than the vehicle braking system). Brake booster 140 may include an internal vacuum reservoir, and it may amplify force provided by foot 152 via brake pedal 150 to master cylinder 148 for applying vehicle brakes (not shown).

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a position sensor 154 coupled to brake pedal 150 for sensing brake pedal position; a knock sensor for determining ignition of end gases (not shown); a measurement of engine manifold pressure (MAP) from pressure sensor 121 coupled to intake manifold 44; a measurement of boost pressure from pressure sensor 122 coupled to boost chamber 46; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Thus, the system of FIG. 1 provides for a vacuum system, comprising: an engine with an intake manifold; a turbocharger coupled to the engine and supplying air the intake manifold; a vacuum reservoir; an ejector in communication with the vacuum reservoir and the turbocharger; and a controller, the controller including instructions for, during a condition where a pressure of the intake manifold is greater than a vacuum reservoir pressure, reducing vacuum reservoir pressure via directing air from a compressor of the turbocharger to the ejector without directing air from the vacuum reservoir to the intake manifold; and during a condition where the pressure of the intake manifold is less than the vacuum reservoir pressure, reducing vacuum reservoir pressure via directing air from the vacuum reservoir to the intake manifold without directing air from the compressor to the ejector. In this way, the output from the ejector may be selectively controlled in response to operating conditions. The controller includes further instructions for suspending cold start spark retard when a pressure in the vacuum reservoir is greater than a threshold pressure. The vacuum system also includes where the controller includes further instructions for decreasing intake manifold pressure via adjusting intake valve timing to decrease intake manifold pressure. The vacuum system further comprises an ejector vacuum flow control valve and further controller instructions for opening the ejector vacuum flow control valve during the condition where the pressure of the intake manifold is greater than the first threshold pressure and where the pressure of the vacuum reservoir is greater than the second threshold pressure. The vacuum system further comprises a first conduit for coupling an outlet of the ejector to the intake manifold and a second conduit for coupling the outlet of the ejector to an intake air system at a location upstream of the compressor.

Referring now to FIGS. 2 and 3, simulated signals of interest during engine operation are shown. Vertical markers $T_0$-$T_{13}$ identify particular times of interest during the operating sequence. The signals of FIG. 2 and the signals of FIG. 3 are signals of a same operating sequence. Thus, times $T_0$-$T_{13}$ of FIG. 2 and FIG. 3 are the identical times.

The first plot from the top of FIG. 2 shows an engine torque command signal versus time. Time starts at the left side of the plot and increases to the right. The engine torque command signal is at its lowest value at the bottom of the plot and it increases in magnitude toward the top of the plot. A lower torque command provides for a lower engine output torque. A higher torque command provides for a higher engine output torque. Horizontal line 202 represents a torque demand threshold whereby air flow to ejector 20 of FIG. 1 may be inhibited so that substantially all pressurized air is made available to the engine rather than the ejector. Thus, when the torque demand exceeds the torque demand threshold 202 the production of engine torque is given priority over vacuum production so that vacuum generation via the ejector ceases and substantially all air flow from the compressor is directed to engine cylinders.

The second plot from the top of FIG. 2 shows engine speed versus time. Time starts at the left side of the plot and increases to the right. Engine speed is at its lowest value at the bottom of the plot and increases toward the top of the plot.

The third plot from the top of FIG. 2 shows engine intake manifold pressure versus time. Time starts at the left side of the plot and increases to the right. Engine intake manifold pressure increases in the direction of the Y-axis arrow. Horizontal marker 204 represents atmospheric pressure in the third plot. Thus, when manifold pressure is above marker 204 the intake manifold is at a positive pressure. When manifold pressure is below marker 204 the intake manifold is at a vacuum.

The fourth plot from the top of FIG. 2 shows vacuum reservoir pressure versus time. Time starts at the left side of the plot and increases to the right. Horizontal marker 206 represents atmospheric pressure in the fourth plot. Horizontal marker 208 represents a second threshold level of vacuum reservoir pressure. Horizontal marker 210 represents a first threshold level of vacuum reservoir pressure. Vacuum reservoir vacuum is at a higher level of vacuum at the bottom of the plot.

The fifth plot from the top of FIG. 2 shows a vacuum consumption rate versus time. The Y axis has units of Kg/s air flow from a higher pressure area (e.g., a vacuum operated actuator) to a lower pressure area (e.g., vacuum reservoir 138 of FIG. 1). The X axis has units of time. Thus, the vacuum consumption rate can be expressed as $Kg/s^2$. Horizontal line 212 represents a first threshold vacuum consumption rate, and horizontal line 214 represents a second threshold vacuum consumption rate, greater than the first threshold vacuum consumption rate. First threshold vacuum consumption rate 212 and second vacuum consumption rate 214 can be adjusted for operating conditions. For example, first threshold vacuum consumption rate 212 and second vacuum consumption rate 214 can be decreased as the vehicle is operated at higher altitudes.

The first plot from the top of FIG. 3 shows compressor flow rate versus time. The compressor may be a turbocharger compressor or a supercharger compressor. Time starts at the left side of the plot and increases to the right. Compressor flow rate increases in the direction of the Y-axis arrow. The solid line 302 represents base compressor flow rate while dotted line 304 represents increased compressor flow rate to supply an ejector air for generating vacuum to supply a vacuum reservoir. The increase in compressor flow rate is related to the vacuum consumption rate within the vacuum system.

The second plot from the top of FIG. 3 shows an ejector vacuum flow control valve command (e.g. valve 22 of FIG. 1). Time starts at the left side of the plot and increases to the right. The ejector vacuum flow control valve is open when the signal is near the top of the plot, and the ejector vacuum flow control valve is closed when the signal is near the bottom of the plot.

The third plot from the top of FIG. 3 shows an intake manifold vacuum flow control valve command (e.g. valve 24 of FIG. 1). Time starts at the left side of the plot and increases to the right. The intake manifold vacuum flow control valve is open when the signal is near the top of the plot, and the intake manifold vacuum flow control valve is closed when the signal is near the bottom of the plot.

The fourth plot from the top of FIG. 3 shows a compressor bypass valve (CBV) command. The compressor bypass valve can direct air flow from the outlet of compressor 162 to the inlet of compressor 162 to limit air pressure in boost chamber 46 and to reduce compressor surge. Time starts at the left side of the plot and increases to the right. The CBV is open when the signal is near the top of the plot, and the CBV is closed when the signal is near the bottom of the plot.

The fifth plot from the top of FIG. 3 represents a signal for limiting use of vacuum by vacuum consumers other than the brake booster and other selected vacuum consumers (e.g., vacuum consumers may include but are not limited to waste gate actuators, heating and ventilation actuators, fuel vapor purging systems, drivetrain actuators, engine crankcase ventilation, and leak check systems). When the vacuum consumer command is near the top of the plot, vacuum consumers may use as much vacuum as they desire. As the vacuum consumer command is reduced, the amount of vacuum available to vacuum consumers is reduced. In other embodiments, the vacuum consumer command may be comprised of two states rather than a variable vacuum control signal. For example, the vacuum consumer command may have a first state where vacuum is made available to secondary vacuum consumers, and the vacuum consumer command may have a second state where secondary vacuum consumers are required to hold in their present state so that no additional vacuum is consumed by the vacuum consumers until the vacuum consumer command returns to the first state.

It should be noted that intake manifold pressure and vacuum reservoir pressure are not plotted to the same scale. For example, the units of the Y axis of the intake manifold pressure plot are not equivalent to the units of the Y axis of the vacuum reservoir plot.

At time $T_0$, the engine is operating at a medium engine torque (e.g., 25% of wide-open-throttle (WOT)). Further, the engine speed is at a medium engine speed (e.g., 2500 RPM), the intake manifold pressure is above atmospheric pressure, pressure in the vacuum reservoir is between a first threshold pressure 210 and a second threshold pressure 208, the vacuum use rate is at a constant low level, the compressor flow rate is low and is not adjusted in response to a rate of vacuum consumption, the ejector vacuum flow control valve is closed, the intake manifold vacuum flow control valve is closed, the CBV is closed, and the vacuum consumer command is at a high level so that full system vacuum is available to secondary vacuum consumers (e.g. vacuum consumers other than the brake booster).

At time $T_1$, the engine torque command is reduced. The engine speed begins to decrease as less engine torque is available to rotate the engine. Intake manifold pressure also begins to decrease since less air is needed for a reduced engine torque demand. The vacuum reservoir pressure begins to increase as vacuum is used to open and then close a turbocharger waste gate. The waste gate closes since the turbocharger can provide the desired mass flow rate using less energy from exhaust gases. The vacuum consumption rate also increases as shown. The vacuum consumption rate may increase in response to use of vacuum by vacuum actuators (e.g., waste gate, heating and ventilation systems, driveline systems, evaporative emission systems, etc.). In one example, the vacuum consumption rate may be expressed as an air flow rate in $Kg/s^2$. As the vacuum consumption rate increases, the compressor flow rate is increased. The compressor flow rate may be increased by opening the ejector flow valve as shown in the second plot from the top of FIG. 3. Further, the ejector flow valve opening time may be modulated to adjust the compressor flow rate. Thus, the flow rate to the ejector may be controlled via adjusting the compressor flow rate and the modulation rate of the ejector vacuum flow control valve. Alternatively, the compressor flow rate may be increased by adjusting a vane position of a variable geometry turbocharger.

The intake manifold vacuum flow control valve is shown in a closed position as the vacuum consumption rate is low. The CBV is also in a closed position since boost pressure is not at a level requiring bypassing the compressor. The vacuum consumer command starts to decrease as the vacuum reservoir pressure begins to increase. In some examples, the vacuum consumer command may limit vacuum consumption in response to a rate of vacuum consumption. In other examples, the vacuum consumer command may limit vacuum consumption in response to a level of vacuum in the vacuum reservoir. Thus, when the vacuum consumption rate is greater than the first vacuum threshold and less than the second vacuum threshold, vacuum is provided to the vacuum reservoir and vacuum system via an ejector.

At time $T_2$, the engine torque command is at a low level and the engine speed continues to decrease. The engine intake manifold pressure also continues to decrease as air is pumped from the engine intake manifold to engine cylinders. The vacuum reservoir pressure increases in response to a high consumption rate of vacuum (e.g., during a brake apply and release sequence). The increase in vacuum consumption can be seen as shown in the fifth plot from the top of FIG. 2. When the vacuum consumption rate is greater than second vacuum consumption threshold 214, the compressor air flow rate is reduced by at least one of changing a turbocharger vane position, closing the ejector vacuum flow control valve, or adjusting a position of a waste gate. Closing the ejector vacuum flow control valve also prevents vacuum from being generated via the ejector. The ejector may be deactivated when it is desirable to restore vacuum to the system at a high rate via the intake manifold. Since the engine has a relatively high volume it may generate a large amount of vacuum in a short amount of time via the engine intake manifold. Thus, the intake manifold vacuum flow control valve is opened to increase the rate at which vacuum is supplied to the vacuum system. However, if the engine torque demand is at a level higher than is possible to achieve with vacuum in the intake manifold, vacuum may continue to be supplied via the ejector. The CBV remains closed and the vacuum consumer command is reduced further so as to reduce the amount of vacuum available to secondary vacuum consumers.

Between time $T_2$ and $T_3$ operation of the engine and/or drivetrain (e.g., engine and transmission) as adjusted to increase the production of vacuum within the engine intake manifold. In one example, the engine intake manifold vacuum is increased by increasing engine speed. Engine speed may be increased by down shifting a transmission or by slipping transmission clutches. Intake manifold vacuum may also be increased via at least one of reducing loads coupled to the engine (e.g., turning off air conditioning), reducing catalyst heating via reducing engine air flow, decreasing the engine throttle opening area, and via advancing intake cam timing. Intake manifold pressure is shown falling below atmospheric pressure (e.g., line 204). Since the intake manifold vacuum flow control valve is open, the vacuum reservoir pressure is reduced. The vacuum consumer command begins to increase as the amount of vacuum in the vacuum reservoir increases. In other examples, the vacuum consumer command can be adjusted in response to a rate that vacuum is produced or a difference between an amount of vacuum consumed and an amount of vacuum produced.

At time $T_3$, the pressure in the vacuum reservoir reaches a level less than a first threshold pressure 210. Consequently, the intake manifold vacuum flow valve is closed in the third plot from the top of FIG. 3, and the engine adjusted to operating conditions where intake manifold pressure can increase to reduce engine pumping work. Engine torque command and engine speed remain at low levels during the time the vacuum reservoir pressure is decreased. It should be noted that the engine may be operated at least in part in response to a rate of vacuum consumption rather than simply attempting to generate vacuum under conditions that the engine usually operates. For example, engine speed can be increased in proportion to a vacuum consumption rate. In this way, the production of engine vacuum may be adjusted to balance vacuum supply with vacuum consumption.

At time $T_4$, the engine torque command and engine speed increase. Such conditions may be present during an operator tip-in (e.g., depression of an accelerator pedal) during a drive cycle. The vacuum use rate also increases at time $T_4$ (e.g., via adjusting a turbocharger waste gate position) and the vacuum reservoir pressure increases as the vacuum consumption rate increases. The compressor flow rate is increased as discussed above. Further, the ejector vacuum flow control valve is opened. Thus, air flow to the ejector is increased so that vacuum may be produced via the ejector thereby decreasing pressure in the vacuum reservoir. The vacuum consumer command is also decreased in response to the rate vacuum is consumed, or alternatively, in response to a pressure or a rate of pressure change within the vacuum reservoir.

Between time $T_4$ and $T_5$ air flows to the ejector and vacuum produced at the ejector lowers the pressure level in the vacuum reservoir. The vacuum generation via the ejector may be activated when the intake manifold pressure is greater than atmospheric pressure or when intake manifold pressure is greater than vacuum reservoir pressure and generating vacuum via the ejector is more efficient than generating vacuum via the intake manifold. As mentioned above, the flow rate of the compressor can be adjusted in response to the rate vacuum is consumed. However, it should be mentioned that it may not be possible to adjust the compressor flow rate during all operating conditions. Therefore, the compressor flow rate may be adjusted during a first condition and not adjusted during a second condition, vacuum being generated via the ejector during both the first and second conditions. As mentioned, in some examples, a flow rate of air passing through the ejector can be adjusted via modulating a valve at the inlet or outlet of the ejector. In many examples, it is desirable to increase the compressor flow rate so that engine power may be maintained while increased compressor flow produces vacuum via the ejector.

At time $T_5$, the vacuum reservoir pressure is reduced to a level below the first pressure threshold 210. Consequently, the ejector vacuum flow control valve is closed so that the use of addition of energy to produce vacuum is ceased. Further, the engine torque command and the engine speed are held substantially constant during the time between $T_4$ and $T_6$.

At time $T_6$, the engine torque command and engine speed are increased by more than double the respective amounts before time $T_6$. The ejector vacuum flow control valve is also opened and the compressor flow rate is increased as indicated by dotted line 304 in response to the rate of increase in vacuum consumption. Since the intake manifold pressure is greater than atmospheric pressure, and since the vacuum consumption rate is less than the second vacuum consumption rate threshold 214, vacuum is produced via the ejector. Activating the ejector and increasing the compressor flow rate causes the increase in the vacuum reservoir pressure to be removed from the vacuum reservoir as indicated by the negative slope of the vacuum pressure signal after the initial pressure increase caused by the increase in vacuum consumption rate. Pressure in the vacuum reservoir also increases briefly after time $T_6$ in response to the increased vacuum consumption rate. The intake manifold vacuum flow control valve is held in a closed position since the vacuum consumption rate is less than the second vacuum consumption rate threshold 214. The vacuum consumer command is also decreased so that the amount of vacuum available to secondary vacuum consumers is reduced.

At time $T_7$, the engine torque command and the engine speed are reduced. Accordingly, the compressor air flow rate is also reduced; however, the compressor continues to operate at a flow rate above the base compressor flow rate (e.g., the compressor flow rate based on engine speed and torque) to continue vacuum production via the ejector. The compressor continues to operate at a flow rate above a base compressor flow rate because the vacuum consumption rate increases as a position of a waste gate and other actuators are adjusted, and because the compressor flow rate is adjusted in response to the vacuum consumption rate. Thus, the ejector vacuum control flow valve is held in an open state so that air can continue to pass through the ejector, thereby producing vacuum for the vacuum reservoir. The change in the engine torque command can also increases the vacuum consumption rate when the system includes a turbocharger having a waste gate that is adjusted in response to torque demand. The increased vacuum consumption rate causes the vacuum reservoir pressure to increase. The vacuum reservoir pressure begins to decline as the ejector continues to generate vacuum.

At time $T_8$, the engine torque command is once again increased. The vacuum consumption rate also increases as the position of the turbocharger waste gate and other vacuum actuators are adjusted. The vacuum reservoir pressure is shown increasing in response to the increased vacuum consumption rate, and the intake manifold pressure is greater than atmospheric pressure so vacuum is provided via the ejector. As such, the ejector vacuum flow control valve is maintained in an open position. In addition, the vacuum consumer command is reduced so that secondary vacuum consumers may be limited in the amount of vacuum they may consume.

At time $T_9$, the engine torque command reaches a torque demand threshold (e.g., horizontal line 202) where air flow to the ejector may be inhibited so that substantially all pressurized air is made available to the engine rather than the ejector. Consequently, the ejector vacuum flow control valve is closed so that substantially all air flow from the compressor may be directed to the engine and intake manifold.

Between time $T_9$ and $T_{10}$, engine torque and engine speed continue to increase while vacuum reservoir pressure gradually increases as the vacuum consumption rate increases with adjustments to the turbocharger waste gate and other vacuum consumers. The vacuum consumer command is decreased as the vacuum reservoir pressure increases.

At time $T_{10}$, the engine torque command and engine speed are reduced. The engine torque command and engine speed may decrease as shown when a driver releases an accelerator pedal after high load acceleration. Further, the intake manifold pressure is reduced at a first rate so that engine torque is reduced, and a short time later, intake manifold pressure is reduced at a second rate in response to an increase in the consumption rate of vacuum so that the pressure increase in the vacuum canister can be reduced. The vacuum consumption rate may increase at a higher rate in response to vacuum consumed during vehicle brake application and release. For example, vacuum is used to assist the operator during depression of the brake, and vacuum is used to evacuate atmospheric pressure from the brake booster when the brake pedal is released. The vacuum reservoir pressure initially increases and then begins to decrease between time $T_{10}$ and time $T_{11}$. The rate of pressure decrease in the vacuum reservoir may be related to the pressure differential between the vacuum reservoir and the intake manifold as well as to the amount of restriction between the intake manifold and the vacuum reservoir.

The consumption rate of vacuum at time $T_{10}$ has increased to a level greater than a second vacuum consumption rate 214. Therefore, the intake manifold vacuum flow control valve is opened and engine operation is adjusted to increase intake manifold vacuum. For example, the engine throttle opening may be decreased and intake valve timing may be adjusted to increase effective cylinder volume (e.g. opening intake valves slightly before top dead center intake stroke and closing intake valves slightly after bottom dead center intake stroke). Further, engine speed may be increased via changing transmission gears or transmission clutch slippage, alternator and air conditioning may be deactivated, and spark timing may be advanced.

In some examples, the pressure level in the vacuum reservoir may also be a parameter for deciding whether or not to generate vacuum via the engine intake manifold. For example, if vacuum reservoir pressure is less than a first threshold, no vacuum is requested via ejector or intake manifold. If vacuum reservoir pressure is greater than the first threshold, but less than a second threshold, vacuum is request via the ejector but not the intake manifold. If vacuum reservoir pressure is greater than the third threshold, vacuum is request via the intake manifold but not the ejector. In other examples, a combination of vacuum consumption rate and vacuum reservoir pressure may be used to determine whether or not to provide vacuum and from which source vacuum is provided. For example, if vacuum reservoir pressure is greater than a first threshold and less than a second threshold while vacuum consumption rate is higher than a second threshold, vacuum may be provided via the intake manifold. On the other hand, if vacuum reservoir pressure is greater than a second threshold and vacuum consumption rate is lower than a second threshold, vacuum may be provided via the ejector.

The ejector vacuum flow control valve remains in a closed state since vacuum can be generated by the engine at a higher rate. However, in some examples, the ejector vacuum flow valve may be opened to act as a CBV. However, in this example a separate CBV is provided. The CBV is shown briefly activated after the engine torque request is reduced so that excess air pumped by the compressor may be discarded. Further, the vacuum consumer command is initially decreased in response to the vacuum reservoir pressure and the vacuum consumption rate, and then the vacuum consumer command is increased to allow secondary vacuum consumers to use additional vacuum.

Thus, between time $T_6$ and time $T_{10}$, the compressor flow rate is adjusted in response to the vacuum consumption rate. Nevertheless, in some examples the compressor flow rate may be adjusted in response to the vacuum consumption rate and the vacuum reservoir pressure. For example, if the vacuum reservoir pressure is a first pressure and the vacuum consumption rate increases at a first rate the compressor flow rate may be increased by a first amount. If the vacuum reservoir pressure is a second pressure, higher than the first pressure, and the vacuum consumption rate increases at the first rate, the compressor flow rate may be increased by a second amount greater than the first amount. In other examples, the compressor flow rate may be adjusted in response to a combination of vacuum consumption rate and vacuum reservoir pressure. For example, if vacuum reservoir pressure is greater than a first threshold pressure and less than a second threshold pressure while vacuum consumption rate is higher than a first threshold flow rate, the compressor flow rate may be increased by a first amount. On the other hand, if vacuum reservoir pressure is greater than a second threshold pressure and the vacuum consumption rate is lower than the first threshold flow rate, the compressor flow rate may be increased by the first amount. Thus, the compressor flow rate may be adjusted in response to a vacuum consumption rate and a pressure of the vacuum reservoir.

At time $T_{11}$, the vacuum reservoir pressure has been reduced to the first threshold level pressure 210. Therefore, the intake manifold vacuum flow control valve is closed and the engine is adjusted to conditions for improving fuel economy and emissions. The intake manifold pressure may be increased during such conditions.

At time $T_{12}$, the engine torque command and engine speed are once again increased. The intake manifold pressure also rises to near atmospheric pressure and the vacuum consumption rate increases as the turbocharger waste gate position and other vacuum actuators are adjusted. In addition, the vacuum reservoir pressure also increases as the vacuum consumption rate increases. The vacuum consumption rate is less than the second threshold vacuum consumption rate 214 so that vacuum is provided via the ejector by opening the ejector vacuum flow control valve. The intake manifold vacuum flow control valve is commanded to a closed position when the vacuum consumption rate is less than a second threshold vacuum consumption rate 214. The compressor flow rate is increased during the engine acceleration beyond a base compressor flow rate so that a portion of the compressor air may be directed to the ejector and so that the vacuum production rate of the ejector can be adjusted in response to the amount of vacuum consumed. Compressed air is directed to the ejector via opening the ejector vacuum flow control valve. And, the vacuum consumer command is decreased since less vacuum is available via the vacuum reservoir.

At time $T_{13}$, the vacuum reservoir pressure decreases to the first threshold pressure level 210. Consequently, additional vacuum is not requested and so the ejector vacuum flow control valve is set to a closed position. The vacuum consumer command is also increased to a level where full vacuum is available to secondary vacuum consumers.

Referring now to FIGS. 4 and 5, the signals and plots of FIGS. 4 and 5 are similar to those shown in FIGS. 2 and 3; however, FIGS. 4 and 5 illustrate intake manifold pressure for a two intake passage intake manifold. And, the vacuum reservoir is in communication with only a first of the two intake passages of the intake manifold. Since the plots and signals are similar, the description of FIGS. 4 and 5 will be limited to new signals and differences as compared to FIGS. 2 and 3 for the sake of brevity. Further, similar numerical markers such as 202 and 402 have the same description and function between FIGS. 2-3 and FIGS. 4-5.

In the third plot from the top of FIG. 4, two intake manifold pressure traces 420 and 422 are shown. Trace 420 represents pressure in a first passage in the intake manifold while trace 422 represents pressure in a second passage in the intake manifold. The first and second passages may be isolated from each other such that the first passage can operate at pressures that are different from pressures in the second passage. In one example, the first passage may supply air to a first group of cylinders, of which, one cylinder from the first group of cylinders combusts every other combustion event, and where each cylinder in the first group combusts an air-fuel mixture once during an engine cycle. The second passage may supply air to a second group of cylinders, of which, one cylinder from the second group of cylinders combusts after a cylinder in the first group of cylinders, and where each cylinder in the second group combusts an air-fuel mixture once during an engine cycle. For example, a four cylinder engine having a combustion order of 1-3-4-2 includes a first passage in the intake manifold supplying air to cylinders 1 and 4 while a second passage in the intake manifold supplies air to cylinders 2 and 3.

During time between $T_2$ and $T_4$ as well as time between $T_{10}$ and $T_{12}$, the two intake air passages operate at different pressures. The air pressure in the first passage is reduced to provide vacuum to the vacuum reservoir, and the air pressure of the second passage is at a higher level to reduce engine pumping work. The reduction in air pressure of the first passage is in response to the vacuum consumption rate exceeding the second vacuum consumption rate 414. In other examples, the pressure in the first passage may be decreased as compared to the pressure in the second passage in response to pressure in the vacuum reservoir. In still other examples, the pressure in the first passage may be reduced as compared to the pressure in the second passage in response to the vacuum consumption rate and the pressure in the vacuum reservoir. Once the pressure in the vacuum reservoir reaches the first pressure threshold 410, the pressure in the first intake manifold is allowed to increase so as to reduce the engine pumping work. The pressure in the first intake manifold may be reduced by any of the previously mentioned methods. The remaining sequence and signals of FIGS. 4-5 are as described in FIGS. 2-3.

Referring now to FIGS. 6-7, a high level flowchart for supplying vacuum in a system having an ejector is shown. The method of FIGS. 6-7 is executable by instructions of controller 12 of FIG. 1.

At 602, method 600 determines engine operating conditions. Engine operating conditions include but are not limited to engine speed, engine load, vacuum reservoir pressure, engine intake manifold pressure, intake throttle position, brake actuator position, and desired engine torque. Method 600 proceeds to 604 after engine operating conditions are determined.

At 604, method 600 judges whether a rate of vacuum consumption is less than a first threshold level. If so, method 600 proceeds to 618. Otherwise, method 600 proceeds to 606.

The first threshold rate may vary depending on operating conditions. For example, the first threshold rate may be reduced when atmospheric pressure is reduced since it may be more difficult to generate a higher pressure differential between atmospheric pressure and vacuum reservoir pressure.

At 606, routine 600 judges whether or not the rate of vacuum consumption is greater than a second threshold level. If so, method 600 proceeds to 622 of FIG. 7. Otherwise, method 600 proceeds to 608. In one example, the second threshold rate is a rate of vacuum consumed during an aggressive application of vehicle brakes. In other examples, method 600 may also include a condition of a pressure in the vacuum reservoir. For example, if pressure in the vacuum reservoir is greater than a second threshold level method 600 proceeds to 622. Alternatively, method 600 may proceed to 622 when either the vacuum consumption rate is greater than a second threshold or when pressure in the vacuum reservoir is greater than a second threshold.

At 608, method 600 judges whether or not the engine torque demand is greater than a threshold level. In one example, the threshold engine torque demand is a torque demand where it is desirable to flow substantially all air from a compressor to engine cylinders. If the engine torque demand is greater than the threshold, method 600 proceeds to 614. Otherwise, method 600 proceeds to 610.

At 610, method 600 opens the ejector vacuum flow control valve and sends pressurized air from the compressor to the ejector. In one example the ejector vacuum flow control valve is electromechanically actuated.

At 612, method 600 adjusts compressor flow in response to a rate of vacuum consumption. In one example, compressor flow may be adjusted via adjusting a position of turbocharger vanes. In another example, the compressor flow rate is adjusted by opening the ejector vacuum flow control valve. In still another example, compressor flow is adjusted by changing a position of a waste gate. In one example, the compressor flow rate is increased as the vacuum consumption rate increases. The compressor flow rate may be increased proportionately with the increase in vacuum consumption rate. Further, the compressor flow rate may be increased in proportion to an amount a pressure in the vacuum reservoir deviates from a desired pressure in the vacuum reservoir. For systems that include a super charger, the compressor flow rate may be adjusted by changing a clutch slip rate.

In addition, method 600 adjusts a vacuum consumer consumption command at 612. In one example, the vacuum consumer command limits the amount of vacuum that secondary vacuum consumers may consume vacuum from the vacuum reservoir. For example, a secondary vacuum consumer may be limited to 50% of its total vacuum consumption capacity. Thus, the vacuum actuator may take more time to achieve a desired position when the vacuum consumer command is reduced. However, if the amount of vacuum in the vacuum reservoir increases or the rate of vacuum consumption decreases, the vacuum consumer command may be increased to allow secondary vacuum consumers to consume additional vacuum. Method 600 proceeds to exit after adjusting the compressor flow rate.

At 614, method 600 closes the ejector vacuum flow control valve. The ejector vacuum flow control valve is closed so that additional air may be supplied to the engine rather than the ejector. Method 600 proceeds to 616 after the ejector vacuum flow control valve is closed.

At 616, method 600 adjusts compressor flow in response to the engine torque request. For example, the compressor flow is adjusted in response to engine speed and the engine torque request without adjusting for air flow through the ejector. Thus, method 600 adjusts the compressor flow according to a base air flow amount.

In addition, method 600 adjusts a vacuum consumer consumption command at 616. In one example, the vacuum consumer command limits the amount of vacuum that secondary vacuum consumers may consume vacuum from the vacuum reservoir. Thus, the vacuum actuator may take more time to achieve a desired position when the vacuum consumer command is reduced. However, if the amount of vacuum in the vacuum reservoir increases or the rate of vacuum consumption decreases, the vacuum consumer command may be increased to allow secondary vacuum consumers to consume additional vacuum.

At 618, method 600 judges whether or not a desired level of vacuum is present with the vacuum reservoir. If so, method 600 proceeds to 620. Otherwise, method 600 proceeds to 606 so that the ejector may supply additional vacuum to the vacuum reservoir. In some examples, the controller includes instructions for suspending cold start spark retard when a pressure in the vacuum reservoir is greater than a threshold pressure whether or not the vacuum consumption rate is above a threshold rate.

At 620, method 600 closes the ejector and intake manifold vacuum flow control valves. The ejector and intake manifold vacuum flow control valves are closed when the vacuum reservoir pressure is low and when the vacuum consumption rate is low. Method 600 proceeds to exit after the ejector and intake manifold vacuum control valves are closed.

In addition, method 600 adjusts a vacuum consumer consumption command at 620. In one example, the vacuum consumer command limits the amount of vacuum that secondary vacuum consumers may consume vacuum from the vacuum reservoir. Thus, the vacuum actuator may take more time to achieve a desired position when the vacuum consumer command is reduced. However, if the amount of vacuum in the vacuum reservoir increases or the rate of vacuum consumption decreases, the vacuum consumer command may be increased to allow secondary vacuum consumers to consume additional vacuum.

Referring now to FIG. 7, method 600 judges whether or not the engine torque demand is greater than a threshold level at 622. When the engine torque demand is greater than a threshold substantially all air flowing from the compressor is directed to engine cylinders. If so, method 600 proceeds to 628. Otherwise, method 600 proceeds to 624.

At 624, method 600 opens the intake manifold vacuum flow control valve so that the intake manifold can draw air from the vacuum reservoir, thereby reducing pressure of the vacuum reservoir. After the intake manifold vacuum flow control valve is opened, method 600 proceeds to 626.

At 626, method 600 adjusts engine operation to provide vacuum to the vacuum reservoir via the intake manifold. Intake manifold pressure can be decreased via shifting to lower gear, increasing engine speed, closing a throttle of the engine, adjusting valve timing, and advancing spark. The adjustment to engine operation may be made in proportion to the vacuum consumption rate and/or the vacuum reservoir pressure. For example, if the vacuum consumption rate is relatively low the engine speed may be increased by a first amount. On the other hand, if the vacuum consumption rate is relatively high the engine speed may be increased by a second amount, greater than the first amount. In systems where two separate intake passages exist in the intake manifold, pressure in one passage may be lower than pressure in a second passage. In this way, the engine may operate a first group of cylinders to provide vacuum while a second group of cylinders are operated to reduce engine pumping work. Method 600 proceeds to exit at FIG. 6 after intake manifold pressure is reduced.

In addition, method 600 adjusts a vacuum consumer consumption command at 626. In one example, the vacuum consumer command limits the amount of vacuum that secondary vacuum consumers may consume vacuum from the vacuum reservoir. Thus, the vacuum actuator may take more time to achieve a desired position when the vacuum consumer command is reduced. However, if the amount of vacuum in the vacuum reservoir increases or the rate of vacuum consumption decreases, the vacuum consumer command may be increased to allow secondary vacuum consumers to consume additional vacuum.

At 628, method 600 adjusts engine operation to provide the desired engine torque demand. For example, method 600 operates pressure of one or more intake manifold passages above atmospheric pressure to provide a desired engine torque. Thus, method 600 can defer decreasing intake manifold pressure to decrease vacuum reservoir pressure during high torque demand conditions.

Further, method 600 adjusts a vacuum consumer consumption command at 628. In one example, the vacuum consumer command limits the amount of vacuum that secondary vacuum consumers may consume vacuum from the vacuum reservoir. Thus, the vacuum actuator may take more time to achieve a desired position when the vacuum consumer command is reduced. However, if the amount of vacuum in the vacuum reservoir increases or the rate of vacuum consumption decreases, the vacuum consumer command may be increased to allow secondary vacuum consumers to consume additional vacuum.

Thus, the method of FIGS. 6-7 provide vacuum for a vehicle, comprising: directing air from a compressor to an ejector; and adjusting a flow rate of air from the compressor in response to a rate of vacuum consumption within a vacuum system. In this way, the turbocharger compressor can be adjusted to provide a desired level of vacuum via an ejector or venturi. The method includes where the air is directed from the compressor to the ejector when a pressure of a vacuum reservoir is greater than a first threshold pressure, and where the air is not directed from the compressor to the ejector when a pressure of the vacuum reservoir is less than the first threshold pressure. The method further comprises directing air from the vacuum reservoir to a low pressure port of the ejector. The method further comprises directing air from the vacuum reservoir to an intake manifold of the engine, and where the rate of vacuum consumption is based on a mass flow of air from a higher pressure to a lower pressure. The method includes where the intake manifold is comprised of at least two passages that may be operated at different pressures, and where a first passage of the at least two passages is operated at a pressure less than the pressure of the vacuum reservoir, and where air flows from the vacuum reservoir to the first passage. The method further comprises commanding at least one vacuum consumer to hold a present state or to a state of reduced vacuum consumption in response to a pressure of a vacuum reservoir. The method further comprises reducing an amount of air flowing through the ejector in response to a torque demand exceeding a threshold torque demand.

In addition, the method of FIGS. 6-7 provide vacuum for a vehicle, comprising: directing air from a compressor to an ejector; adjusting a flow rate of air from the compressor in response to a rate of vacuum consumption within a vacuum system; and directing an output of the ejector to an air intake system of an engine. The method further comprises directing air from a vacuum reservoir to a low pressure port of the ejector, and where the output of the ejector is directed to a location in the air intake system upstream of the compressor or to an intake manifold of the engine. The method further comprises directing air from the vacuum reservoir to an intake manifold of the engine. The method further comprises reducing a pressure of the intake manifold via increasing slipping a clutch of a transmission. The method further comprises reducing a pressure of the intake manifold via down shifting a transmission to increase engine speed and decrease engine load. In one example, the method further comprises reducing a pressure of the intake manifold via selectively reducing loads coupled to the engine. In another example, the method further comprises decreasing the flow rate of air from the compressor in response to adjusting operation of the engine to decrease the pressure of the intake manifold of the engine. The method also further comprises decreasing the flow rate of air from the compressor when a torque demand of the engine exceeds a threshold level.

As will be appreciated by one of ordinary skill in the art, the methods described in FIGS. 6-7 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. A method for providing vacuum for a vehicle, comprising:

directing air from a compressor of an engine turbocharger to an ejector; and adjusting a flow rate of air from the compressor in response to a rate of vacuum consumption within a vacuum system.

2. The method of claim 1, where the air is directed from the compressor to the ejector when a pressure of a vacuum reservoir is greater than a first threshold pressure, and where the air is not directed from the compressor to the ejector when the pressure of the vacuum reservoir is less than the first threshold pressure.

3. The method of claim 2, further comprising directing air from the vacuum reservoir to a low pressure port of the ejector.

4. The method of claim 3, further comprising directing air from the vacuum reservoir to an intake manifold of an engine, and where the rate of vacuum consumption is based on a mass flow of air from a higher pressure to a lower pressure.

5. The method of claim 4, where the intake manifold is comprised of at least two air intake passages that may be operated at different pressures, and where a first passage of the at least two passages is operated at a pressure less than the pressure of the vacuum reservoir, and where air flows from the vacuum reservoir to the first passage.

6. The method of claim 1, further comprising commanding at least one vacuum consumer to hold a present state or to a state of reduced vacuum consumption in response to a pressure of a vacuum reservoir.

7. The method of claim 1, further comprising reducing an amount of air flowing through the ejector in response to a torque demand exceeding a threshold torque demand.

8. A method for providing vacuum for a vehicle, comprising:

directing air from a compressor to an ejector;

adjusting a flow rate of air from the compressor in response to a rate of vacuum consumption within a vacuum system; and directing an output of the ejector to an air intake system of an engine.

9. The method of claim 8, further comprising directing air from a vacuum reservoir to a low pressure port of the ejector, and where the output of the ejector is directed to a location in the air intake system upstream of the compressor or to an intake manifold of the engine.

10. The method of claim 9, further comprising directing air from the vacuum reservoir to the intake manifold of the engine.

11. The method of claim 10, further comprising reducing a pressure of the intake manifold via increasing slipping a clutch of a transmission.

12. The method of claim 10, further comprising reducing a pressure of the intake manifold via down shifting a transmission to increase engine speed and decrease engine load.

13. The method of claim 10, further comprising reducing a pressure of the intake manifold via selectively reducing loads coupled to the engine.

14. The method of claim 13, further comprising decreasing the flow rate of air from the compressor in response to adjusting operation of the engine to decrease the pressure of the intake manifold of the engine.

15. The method of claim 8, further comprising decreasing the flow rate of air from the compressor when a torque demand of the engine exceeds a threshold level.

16. A vacuum system, comprising:

an engine with an intake manifold;

a turbocharger coupled to the engine and supplying air to the intake manifold;

a vacuum reservoir;

an ejector in communication with the vacuum reservoir and the turbocharger; and a controller, the controller including non-transitory instructions for, during a condition where a pressure of the intake manifold is greater than a vacuum reservoir pressure, reducing vacuum reservoir pressure via directing air from a compressor of the turbocharger to the ejector without directing air from the vacuum reservoir to the intake manifold; and during a condition where the pressure of the intake manifold is less than the vacuum reservoir pressure, reducing vacuum reservoir pressure via directing air from the vacuum reservoir to the intake manifold without directing air from the compressor to the ejector.

17. The vacuum system of claim 16, where the controller includes further non-transitory instructions for suspending cold start spark retard when a pressure in the vacuum reservoir is greater than a threshold pressure.

18. The vacuum system of claim 16, where the controller includes further non-transitory instructions for decreasing intake manifold pressure via adjusting intake valve timing to decrease intake manifold pressure.

19. The vacuum system of claim 16, further comprising an ejector vacuum flow control valve and further non-transitory controller instructions for opening the ejector vacuum flow control valve during a condition where the pressure of the intake manifold is greater than a first threshold pressure and where the pressure of the vacuum reservoir is greater than a second threshold pressure.

20. The vacuum system of claim 16, further comprising a first conduit for coupling an outlet of the ejector to the intake manifold and a second conduit for coupling the outlet of the ejector to an intake air system at a location upstream of the compressor.

* * * * *